US007704337B2

(12) United States Patent
Kanemitsu et al.

(10) Patent No.: US 7,704,337 B2
(45) Date of Patent: Apr. 27, 2010

(54) METHOD FOR MAKING A SLIDE MEMBER

(75) Inventors: Hiroshi Kanemitsu, Toyota (JP); Masaharu Hatta, Toyota (JP)

(73) Assignee: Taiho Kogyo Co., Ltd., Toyota-shi (JP)

( * ) Notice: Subject to any disclaimer, the term of this patent is extended or adjusted under 35 U.S.C. 154(b) by 244 days.

(21) Appl. No.: 11/794,607

(22) PCT Filed: Dec. 27, 2005

(86) PCT No.: PCT/JP2005/023861

§ 371 (c)(1),
(2), (4) Date: Jun. 28, 2007

(87) PCT Pub. No.: WO2006/075520

PCT Pub. Date: Jul. 20, 2006

(65) Prior Publication Data

US 2009/0205754 A1 Aug. 20, 2009

(30) Foreign Application Priority Data

Jan. 17, 2005 (JP) ..... 2005-009166
Jan. 28, 2005 (JP) ..... 2005-021984

(51) Int. Cl.
*C21D 9/00* (2006.01)

(52) U.S. Cl. ..... 148/565; 148/639

(58) Field of Classification Search ..... None
See application file for complete search history.

(56) References Cited

U.S. PATENT DOCUMENTS 4,658,111 A * 4/1987 Takagi et al. ..... 219/125.1
6,435,047 B1 * 8/2002 Kitagawa et al. ..... 74/60
2006/0093246 A1 * 5/2006 Akita et al. ..... 384/279

FOREIGN PATENT DOCUMENTS

| | | |
|---|---|---|
| JP | 02-093018 | 4/1990 |
| JP | 02-173212 | 7/1990 |
| JP | 07-113421 | 5/1995 |
| JP | 10-072618 | 3/1998 |
| JP | 10-153169 | 6/1998 |
| JP | 11-107913 | 4/1999 |
| JP | 2000-145625 | 5/2000 |
| JP | 2002-317757 | 10/2002 |
| TW | 432165 A * | 5/2001 |

* cited by examiner

*Primary Examiner*—George Wyszomierski
(74) *Attorney, Agent, or Firm*—Flynn, Thiel, Boutell & Tanis, P.C.

(57) ABSTRACT

A sliding surface 4A of a shoe 4 undergoes laser radiation in a shape of a large number of parallel lines to form a large number of swollen portions 6 and concave portions 7 in adjacent positions thereof. The swollen portions 6 and the inner side thereof become direct-hardened portions 11 with a high hardness and the concave portions 7 and the inner side thereof become double-hardened portions 12, which are lower in hardness than the swollen portions 6.

After the laser hardening, the sliding surface 4A undergoes lapping up to a position of an imaginary line 15 to delete the relief and form a flat and smooth plane. Thereafter the sliding surface 4A undergoes buffing so that portions with a low hardness are chipped off more than portions with a high hardness to form a large number of minute irregularities on the sliding surface 4A.

9 Claims, 6 Drawing Sheets

IN CASE OF P/B=0.5

IN CASE OF P/B=1

METHOD FOR MAKING A SLIDE MEMBER

TECHNICAL FIELD

The present invention relates to a method for manufacturing a slide member and, in particular, to a method for manufacturing, for example, a slide member suitable for manufacturing a shoe of a swash plate compressor.

BACKGROUND ART

Conventionally, a swash plate compressor comprising a swash plate and a hemispheric shoe sliding thereon is known (see Patent Document 1 and Patent Document 2, for example).

The above-described hemispheric shoe is configured by a sliding surface that slides on the above-described swash plate and a hemispheric convex surface that is formed in a hemispheric shape. The above-described sliding surface is formed to present a center-tall shape so that the center portion gets slightly higher than the outer periphery by around several μm.

Thus, conventionally, by making the sliding surface of a shoe in a center-tall shape, a swash plate and a shoe are caused to create a slight gap into which lubrication oil is introduced to form an oil film. Thereby, friction between the swash plate and the shoe is reduced.

Patent Document 1: Japanese Patent Laid-Open No. 10-153169

Patent Document 2: Japanese Patent Laid-Open No. 2002-317757

DISCLOSURE OF THE INVENTION

Issues to be Solved by the Invention

Here, the conventional swash plate compressor described above is designed for use under a condition with a rapid speed and a high load and, moreover, under a condition with a small amount of lubrication oil. In this way, recently, the operating conditions of a swash plate compressor have been more severe, and hence, there arise issues that wear of a swash plate or a shoe becomes extreme, and moreover, seizure of them easily arises.

Moreover, in order to improve the slide performance of a shoe, the sliding surface of a shoe undergoes surface processing and processing such as a quality change. However, such processing has a disadvantage that the manufacturing cost of a shoe is high.

Therefore, as a result of research by the inventor of the present application, it turns out to be effective to form minute irregularities on a sliding surface of a shoe and introduce a lubrication oil thereinto in order to improve the lubricant properties between a swash plate and the sliding surface of a shoe.

As a conventional processing method for making such minute irregularities on a sliding surface, etching, cutting work, rolling, micro shot and electro-discharge machining, for example, are known. However, production of minute irregularities on the sliding surface of a shoe with such a publicly known conventional processing method gives rise to the following disadvantages. That is, in a conventional processing method, it is difficult to form a uniform and smooth relief having less than several μm on a sliding surface. So, the relief surface gets coarser. Moreover, the manufacturing costs get higher. In addition, it is disadvantageous that the processing of the sliding surface after forming the relief on the sliding surface causes the relief to disappear.

Means for Solving the Problems

In view of the circumstances described above, the present invention provides a method for manufacturing a slide member characterized by:

radiating a laser or electronic beam for hardening the sliding surface of a slide member to produce portions having a different hardness on the sliding surface;

removing the surface of the above-described sliding surface to temporarily smooth the surface of the sliding surface; and buffing the above-described sliding surface to form minute irregularities on the sliding surface.

In addition, the present invention provides a method for manufacturing a slide member designed so that a sliding surface of a slide member undergoes laser or electronic beam radiation so as to draw a large number of parallel lines or concentric circles spaced apart in a predetermined pitch P; the above-described sliding surface undergoes a hardening process with a predetermined hardening width B at the time of the irradiation thereof to concurrently give rise to portions having a different hardness on the surface of the slide member to form minute irregularities on the above-described sliding surface, characterized in that:

a ratio P/B of the above-described pitch P to the hardening width B is set as follows:

$0.4 \leqq P/B \leqq 4.0$, where $P/B=1$ and $P/B=0.5$ are excluded.

EFFECT OF THE INVENTION

Such a manufacturing method enables uniform minute irregularities to be formed on a sliding surface of a slide member in an ensured manner. In such a slide member having minute irregularities on a sliding surface, lubrication oil will be introduced into inside the above-described minute irregularities. Therefore, it will become possible to improve a seizing resistant property of the slide member.

Moreover, the relation between the above-described pitch P and the hardening width B is set to a ratio described above and, thereby, a slide member excellent in seizing-resistant property can be provided as described in a test result below.

BEST MODE FOR CARRYING OUT THE INVENTION

The present invention will be described with an embodiment as follows. In FIG. 1, a slide device 1 is provided inside a housing of a swash plate compressor. That slide device 1 is configured by a swash plate 3 inclined and installed in a rotary shaft 2 that is rotatably supported inside the above-described housing and a plurality of shoes 4 that slide on that swash plate 3.

The swash plate 3 is formed in a disk shape and the end surfaces of the swash plate 3 act as flat sliding surfaces 3A and 3A that slide on the shoes 4.

On the other hand, a shoe 4 as a slide member is formed in a hemispheric shape in its entirety and is configured by a sliding surface 4A that slides on a sliding surface 3A of the above-described swash plate 3 and a hemispheric convex surface 4B formed in a hemispheric shape.

Inside the housing of the above-described swash plate compressor, a plurality of pistons 5 are arranged in parallel with the rotary shaft 2 to surround the same. Two shoes 4 in a set are slidably retained inside a notched portion 5A in a circular shape formed in an end of each piston 5. The notched portion 5A in that state is arranged so as to embrace the outer periphery portion of the above-described swash plate 3 and, at the same time, the sliding surface 4A of a shoe 4 in each set is caused to contact the sliding surface 3A of the swash plate 3.

The above-described rotary shaft 2 rotates. Then, the swash plate 3 rotates so that the sliding surface 3A at both end surfaces of the swash plate 3 and the sliding surface 4A of a shoe 4 in each set are caused to slide and the notched portion 5A and hemispheric convex surface 4B of the shoe 4 in each set are caused to slide. Concurrently, each piston 5 is caused to move in a reciprocal manner in the axial direction via the shoe 4 in each set.

The above-described configuration is not different from the configuration of a conventional known slide device.

Then, the shoe 4 of the present embodiment is made of SUJ2, a material of an iron system, and the schematically flat sliding surface 4A configured by an end surface is made in a center-tall shape with its center being slightly higher (by around 2 μm) than the outer periphery. That provides a shape easily allowing lubrication oil to be introduced in between both sliding surfaces 4A and 3A at the time when the sliding surface 4A slides on the sliding surface 3A of the above-described swash plate 3.

In the present embodiment, the sliding surface 4A of the shoe 4, as a slide member, undergoes laser hardening in its entire region and, thereafter, undergoes processing to, thereby, improve the seizing-resistant property of the sliding surface 4A.

That is, in the description of the manufacturing process of the shoe 4 in the present invention embodiment, at first, a hemispheric shoe 4 as a base material is manufactured with SUJ2. Next, as illustrated in FIG. 2 and FIG. 4, the entire surface of the sliding surface 4A being an end surface of the shoe 4 as a base material undergoes irradiation by a YAG laser so that a large number of parallel lines A are drawn in a predetermined identical pitch P. In the present embodiment, the above-described pitch P is set to 0.1 to 1 mm.

The output of the YAG laser irradiated onto the above-described sliding surface 4A is 50 W. By adjusting a condenser lens so that the YAG laser is focused in the position at 2 mm in depth onto the surface of the sliding surface 4A, YAG laser radiation is designed to draw the above-described parallel lines A in a defocused state on the surface of the sliding surface 4A.

Thus, the site of each parallel line A in the surface of the sliding surface 4A having undergone laser radiation is swollen as illustrated in FIG. 4 to form a swollen portion 6 in a substantially circular arc shape in section. A concave portion 7 forming a line-shaped groove is formed between those adjacent swollen portions 6. That is, as described above, laser radiation onto the sliding surface 4A is designed to form minute irregularities on the surface of the sliding surface 4A with a large number of line-shaped swollen portions 6 and concave portions 7. The height of the above-described swollen portions 6 (depth of the concave portions 7) is generally around 0.1 to 1 μm.

Thus, laser radiation on the sliding surface 4A is designed to cause the entire area of the surface of the sliding surface 4A to undergo hardening. As illustrated in FIG. 4, the range undergoing hardening by laser radiation on the above-described sliding surface 4A will be shaped semicircularly with the surface being the laser radiation location (each parallel line A) as a center so that the laser radiation location and portions on its both sides, as well as on the inward sides, will undergo hardening.

That is, the swollen portions 6 and the inner side in the direction of depth thereof (region at approximately 70 μm in depth to become the upper side than dashed lines 8 in circular arc shapes in FIG. 4) will be direct-hardened portions 11.

The hardening width B of the direct-hardened portion 11 with laser radiation on the position of each of the above-described parallel lines A is set to 0.25 mm so that the position up to the concave portions 7 located at both sides of the swollen portion 6 undergoes direct hardening.

In the present embodiment, the adjacent parallel lines A are spaced apart to keep a pitch P set to 0.1 to 1 mm. The hardening width B is set to 0.25 mm. Therefore, when portions of the adjacent parallel lines A sequentially undergo a hardening process with laser radiation, the portions becoming the above-described concave portions 7 will undergo hardening a second time. Therefore, the portion on the inward side of the concave portions 7 is a double-hardened portion 12 shaped like an inverted triangle in section.

In addition, a predetermined region located inward from the above-described direct-hardened portions 11 and the double-hardened portions 12 in depth (region between a wave-like dashed line 13 and the above-described dashed line 8) forms an inner-hardened layer 14 with a thickness of approximately around 50 μm. That is, the above-described direct-hardened portions 11, the double-hardened portions 12 and the inner-hardened layer 14 to be located on the inward side adjacent thereto undergo laser hardening. In the present embodiment, the direct-hardened portion 11 has a hardness H1; the double-hardened portion 12 has a hardness H2; the inner-hardened layer 14 has a hardness H3; and the base material of the shoe 4 has a hardness H. They are designed to have different hardnesses and the relation thereof in hardness will be as follows:

$$H1>H2>H>H3$$

That is, in viewing from the surface side, the sliding surface 4A after laser hardening, the swollen portions 6 and the concave portions 7 are formed alternately so as to be adjacent to each other. Those portions give rise to differences in hardness due to laser hardening on the surface side and in the direction of the depth.

For reference's sake, a test carried out by the inventor provides a hardness of H1=Hv850, H2=Hv800, H=Hv750 and H3<Hv750 in the case where, for example, the above-described pitch P is 0.2 mm and the above-described hardening width B is 0.25 mm.

The present embodiment is designed to carry out hardening across the entire surface of the sliding surface 4A with laser radiation so as to draw a large number of parallel lines A in the above-described pitch P on the sliding surface 4A of the shoe 4 and to thereby give rise to a difference in hardness on the surface of the sliding surface 4A and in the direction of the depth thereof.

In addition, in the present embodiment, the ratio P/B of the pitch P separating the above-described adjacent parallel lines A to the hardening width B is set to fall within the range of 0.4 to 4.0.

Moreover, in the present embodiment, after the sliding surface 4A undergoes a hardening process with laser radiation as described above, the surface of the sliding surface 4A undergoes a lapping process to the position indicated by an imaginary line 15 in FIG. 4 to delete the relief configured by the above-described swollen portions 6 and the concave portions 7.

Thus, the depth to be chipped off by the lapping process from the surface of the sliding surface 4A is set to a depth which reaches the inner side of the concave portions 7 after the swollen portions 6 are completely chipped off. Accordingly, as illustrated in FIG. 5 as a simplified portion, the sliding surface 4A after the lapping process will form a flat and smooth surface to enter a state of exposing the direct-hardened portion 11 and the double-hardened portions 12 having a lower hardness than the direct-hardened portion 11.

Next, in the present embodiment, after the above-described lapping process, the entire region of the sliding surface of the above-described shoe 4 undergoes buffing to finalize the process.

After the process thus comes to an end, as illustrated in FIG. 3 and FIG. 6, swollen portions 6' similar to the above-described swollen portions 6 are formed in portions (inward side of the above-described swollen portions 6) of the above-described direct-hardened portions 11 in the entire region of the sliding surface 4A of the shoe 4 and concave portions 7' similar to the above-described concave portions 7 are formed in portions (inward side of the above-described concave portions 7) of the double-hardened portions 12. Thereby, on the sliding surface 4A of the shoe 4 after the process, a large number of minute irregularities are formed uniformly.

The reason why minute irregularities appear after the process is that portions differing in hardness enter a state of being exposed on the sliding surface 4A after the above-described lapping processing, the sliding surface 4A undergoes buffing in that state and, therefore, a great amount of the double-hardened portions 12 which are lower in hardness are removed in the direction deeper than the direct-hardened portions 11.

The difference in height (depth) of the above-described swollen portions 6' and concave portions 7' is approximately 0.1 to 0.8 μm so that the concave portions 7' function as a reservoir portion and a lubrication oil channel into which lubrication oil is introduced.

As described above, in the present embodiment, the sliding surface 4A of the shoe 4 is designed to undergo a hardening process by a laser so as to cause portions having different hardnesses to appear on the surface of the sliding surface 4A and in the direction of the depth thereof and to finish manufacturing the shoe 4 with the subsequent lapping process and buffing. The ratio P/B is the proportion of the above-described pitch P to the hardening width B and is set to fall within the range of 0.4 to 4.0.

On the sliding surface 4A of the shoe 4 after manufacture, minute irregularities are formed with a large number of the above-described swollen portions 6' and the concave portions 7' and lubrication oil is designed to be reserved inside the concave portions 7'. Thereby, an oil film of lubrication oil is designed to be maintained in the entire region of the above-described sliding surface 4A. Therefore, the manufacturing method of the present embodiment can provide a shoe 4 having an excellent seizing-resistant property. In addition, it is possible to improve the load capacity of the sliding surface 4A of the shoe 4 and eventually it is possible to provide a shoe 4 having an excellent wear-resistant property.

FIG. 7 and FIG. 8 illustrate test results of the seizing performance of the shoe 4 of the above-described present embodiment. Here, the test conditions are as follows:

(Test Conditions)

Swash plate rotation: nine-step increase by 1000 rpm every minute: maximum rotation of 9000 rpm (circumferential velocity of 38 m/s)

Surface pressure: preload of 2.7 MPa and increase by 2.7 MPa every minute: until an occurrence of seizing Oil mist amount: 0.05 g/min with the position of a nozzle being fixed Oil: refrigerating machine oil Seizing condition: over a shaft torque of 4.0 N·m As described above, for the present embodiment, the pitch P is set to fall within the range of 0.1 to 1 mm. The relation P/B between that pitch P and the hardening width B (0.25 mm) with laser radiation is set to fall within the range of 0.4 to 4.0. As indicated by white circles in FIG. 7, in the case of the pitch P of 0.2 mm, 0.4 mm, 0.5 mm and approximately 0.8 mm (P/B falling within the range of 0.8 to 3.0), the seizing performance is not less than 25 MPa for all the cases, providing an excellent seizing-resistant property. In addition, in the case of the pitch P of 0.1 mm and 1.0 mm, the seizing performance is around 15 MPa, providing a good seizing-resistant property. In contrast, with the pitch P being zero, that is, in the case of one equivalent to the prior arts, the seizing performance is 5 MPa. Thus, the shoe 4 of the above-described present embodiment is provided with a good seizing-resistant property.

Moreover, FIG. 8 illustrates a result of setting the pitch P to 0.2 mm and the hardening width B to 0.25 mm to manufacture the shoe 4 with buffing to provide a difference in height (depth of the concave portions 7') between the swollen portions 6' and the concave portions 7' to review the seizing performance of those shoes 4.

The sliding surface 4A with the concave portions 7' falling within the range of 0.2 to 0.4 μm in depth has a seizing performance of 25 MPa or more, providing an excellent seizing-resistant property. On the other hand, in the case where there is no concave portion 7', that is, in the case of one equivalent to the prior arts, the seizing performance is 5 MPa. In addition, the one with the concave portions 7' being 0.5 μm to 1.0 μm in depth is also provided with good seizing-resistant property compared with the prior arts.

In contrast, as illustrated in FIG. 9, in the case of setting the laser radiation pitch P to a half of the hardening width B in the above-described embodiment (in the case of P/B=0.5), good seizing-resistant property was not obtained.

In that case, since the laser radiation pitch P is a half of the hardening width B, only the portions of the parallel lines A irradiated by the laser undergo triple hardening to form triple-hardened portions 17 so that all of the adjacent sides of those triple-hardened portions 17 form double-hardened portions 12.

The triple-hardened portions 17 are lower in hardness than the double-hardened portions 12. The triple-hardened portions 17 are formed to shape lines only in the portions of the parallel lines A that undergo the above-described laser radiation. Therefore, as illustrated in FIG. 9 hereof, the case where the sliding surface 4A undergoes a lapping process to provide a flat and smooth state and thereafter the sliding surface 4A undergoes buffing will also result in buffing the double-hardened portions 12 with the same hardness to become substantially the entire region of the sliding surface 4A. Accordingly, in that case, no uniform minute irregularities of less than several μm on the sliding surface 4A after buffing can be formed and the hardening-resistant property is not good.

Moreover, as illustrated in FIG. 10, also in the case where the laser radiation pitch P and the hardening width B with laser radiation are made the same (P/B=1) to manufacture the shoe 4 in the present embodiment, the good seizing performance was not obtained.

In the case illustrated in FIG. 10, substantially the entire region of the surface of the sliding surface 4A will become the direct-hardened portions 11 so that the double-hardened portions 12 will be formed as shape lines only at the boundary portions of the adjacent direct-hardened portions 11. Therefore, as illustrated in FIG. 10 thereof, the surface of the sliding surface 4A is temporarily made flat and smooth by a lapping process and thereafter the sliding surface 4A undergoes buffing. Nevertheless, the surface of the sliding surface 4A is kept in a flat state to enable no minute irregularities to be formed.

The test result of the seizing-resistant property in that case is 2 MPa as indicted by "X" in FIG. 7 and the hardening-resistant property is not good.

Here, in the present embodiment described above, the sliding surface 4A of the shoe 4 undergoes hardening with laser radiation so as to draw a large number of parallel lines. However, as illustrated in FIG. 11, the sliding surface 4A can undergo hardening with laser radiation in a lattice shape.

In addition, as illustrated in FIG. 12, the sliding surface 4A can undergo hardening with laser radiation to draw a large number of concentric circles so that adjacent circles differing in size are spaced apart at the same pitch P.

In addition, FIG. 13 illustrates the case where the sliding surface 4A undergoes spiral laser radiation in the counter-clockwise direction. Moreover, FIG. 14 illustrates the case where the sliding surface 4A undergoes laser radiation so as to draw a large number of small circles arranged in a zigzag shape.

As illustrated in FIGS. 11 to 14, even if the laser radiation pattern onto the sliding surface 4A is changed, the portions having undergone laser radiation are swollen. Thereby, swollen portions are formed and concave portions are formed in the adjacent positions thereof. Thus, the sliding surface 4A undergoes laser radiation and thereby the sliding surface 4A undergoes hardening to give rise to a difference in hardness on the surface of the sliding surface and in the direction of the depth thereof. As the process after the laser hardening process, the sliding surface 4A undergoes lapping as in the embodiment described above to temporarily form a flat and smooth surface. Then, the sliding surface 4A undergoes buffing.

Also, such a shoe 4 manufactured with the laser radiation pattern as illustrated in FIGS. 11 to 14 can obtain the same operations and advantages as in the present embodiment described above.

In addition, the present embodiment describes the case where the manufacturing method of the present invention is applied to the manufacture of a shoe 4 as a slide member. However, the present invention can be applied to a manufacturing method for manufacturing the above-described swash plate 3. Otherwise, the present invention is also applicable as a method for manufacturing a slide member in a mechanical device where two slide members slide.

Moreover, the hemispheric shoe 4 in the above-described present embodiment includes a shoe with the generally flat-shaped hemispheric convex surface 4B crushed in the shaft direction.

In addition, in the above-described embodiment, the sliding surface 4A of the shoe 4 undergoes YAG laser radiation to carry out the hardening process. However, another laser such as a carbon dioxide gas laser can also be used instead of the YAG laser. An electronic beam can also be used instead of a laser.

DESCRIPTION OF SYMBOLS

Figure 1:
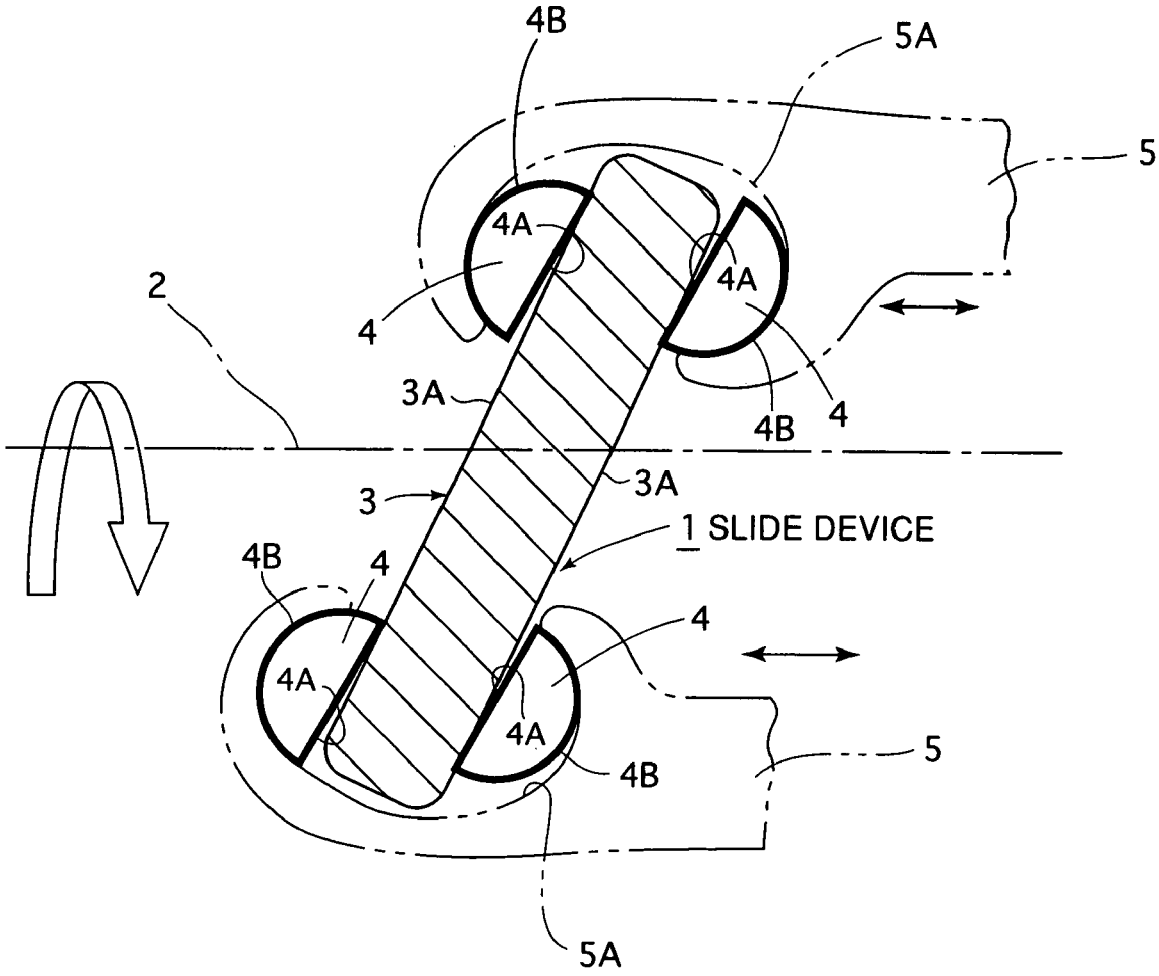
FIG. 1 is a sectional view of a slide device embodiment of the present invention.
Figure 2:
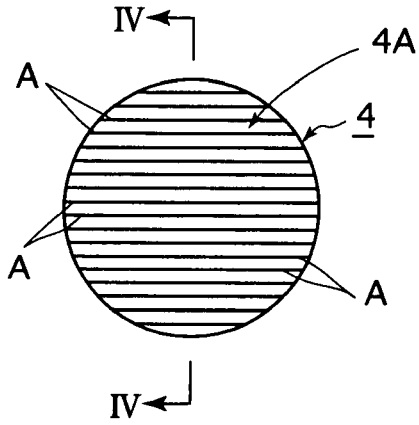
FIG. 2 is a front view of the sliding surface 4A at the time of manufacturing the shoe illustrated in FIG. 1.
Figure 3:
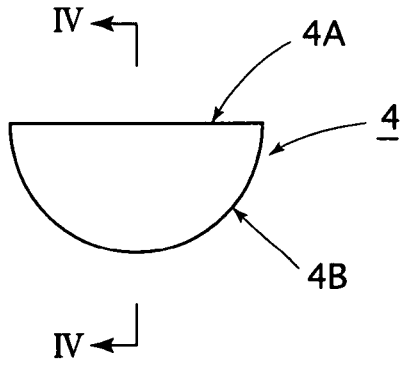
FIG. 3 is an enlarged view of the shoe illustrated in FIG. 1.
Figure 4:
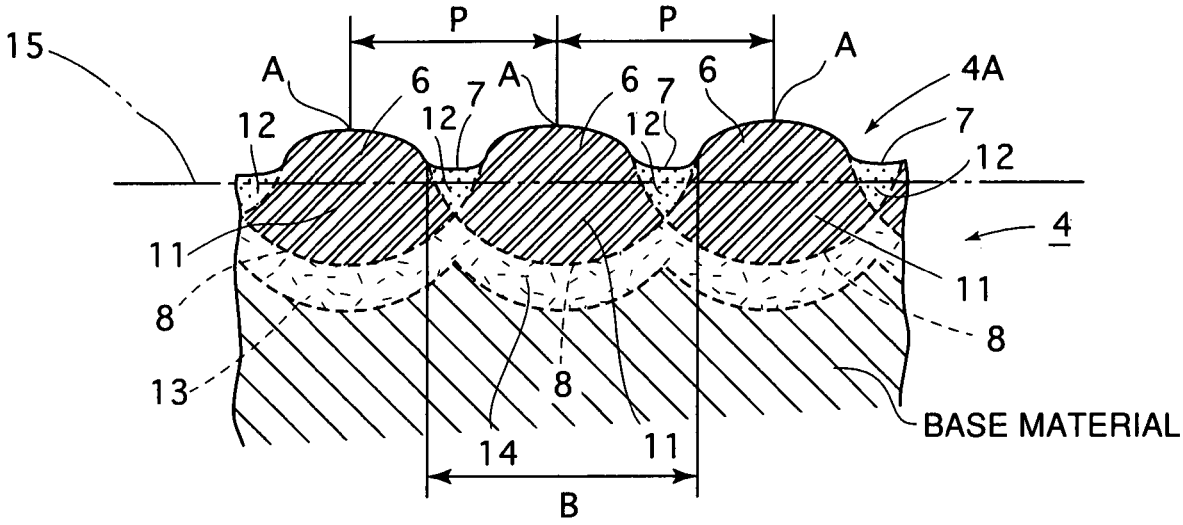
FIG. 4 is an enlarged sectional view of main parts along the IV-IV line in FIG. 2.
Figure 5:
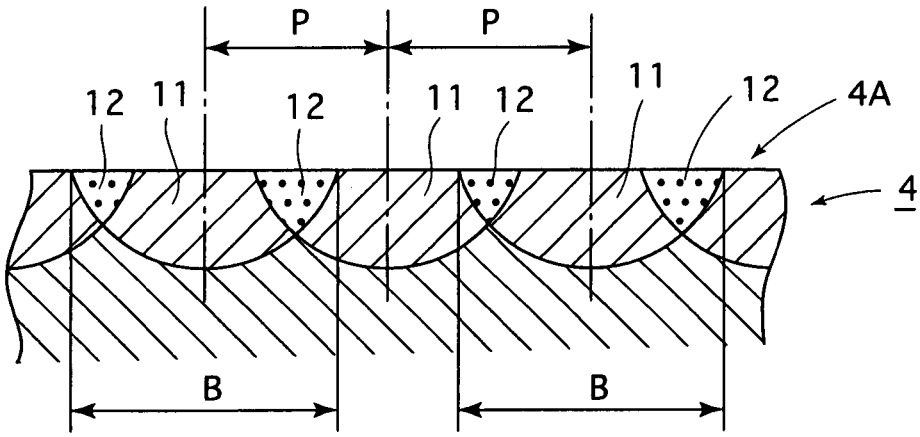
FIG. 5 is a simplified sectional view illustrating a manufacturing process subsequent to FIG. 4.
Figure 6:
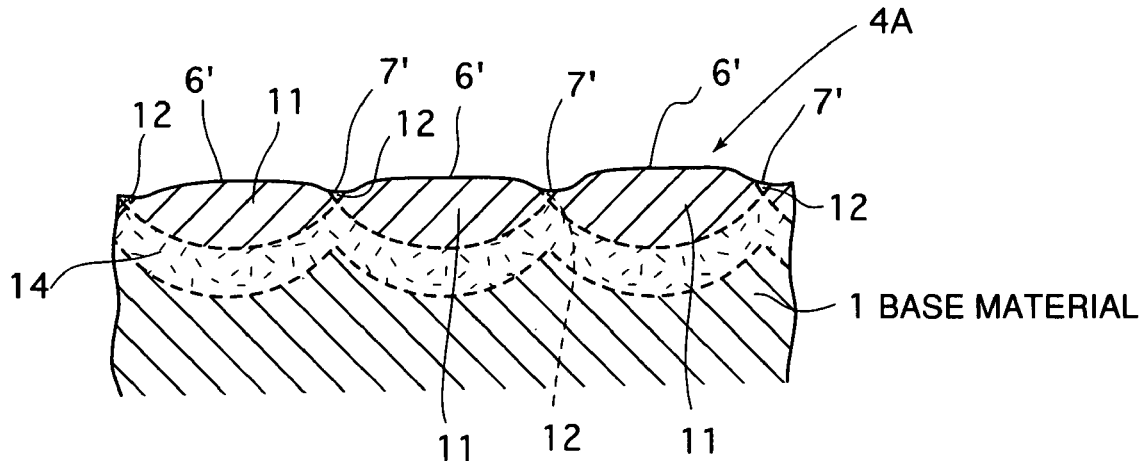
FIG. 6 is an enlarged sectional view of the main parts along the VI-VI line in FIG. 3.
Figure 7:
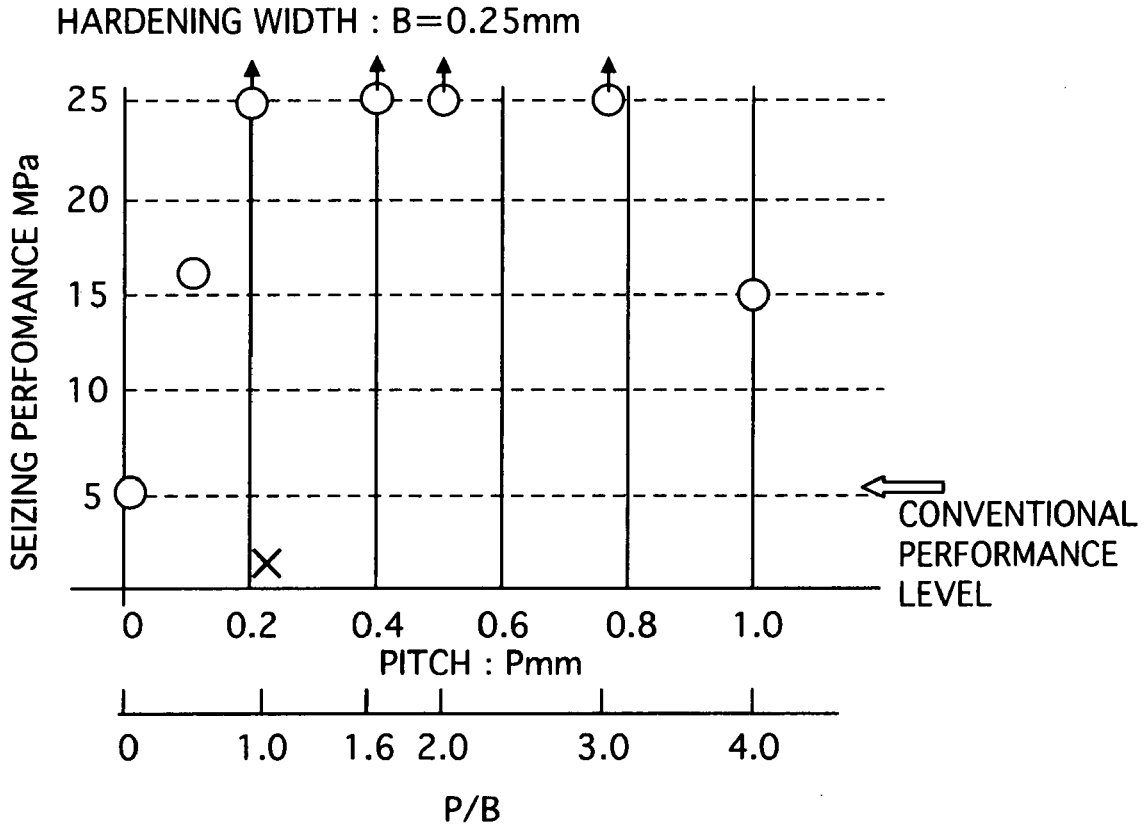
FIG. 7 is a diagram illustrating the seizing performances of the shoe of the embodiment illustrated in FIG. 1 and a comparative example.
Figure 8:
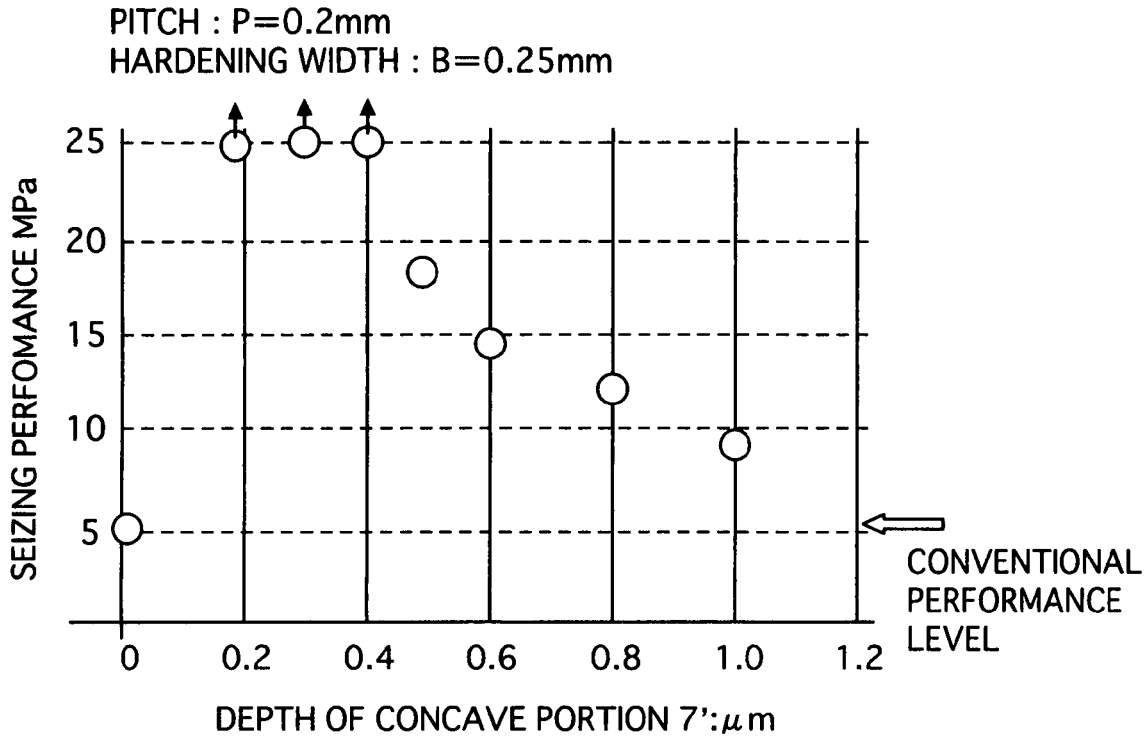
FIG. 8 is a diagram illustrating the seizing performances of the shoe of the embodiment illustrated in FIG. 1 and a comparative example.
Figure 9:
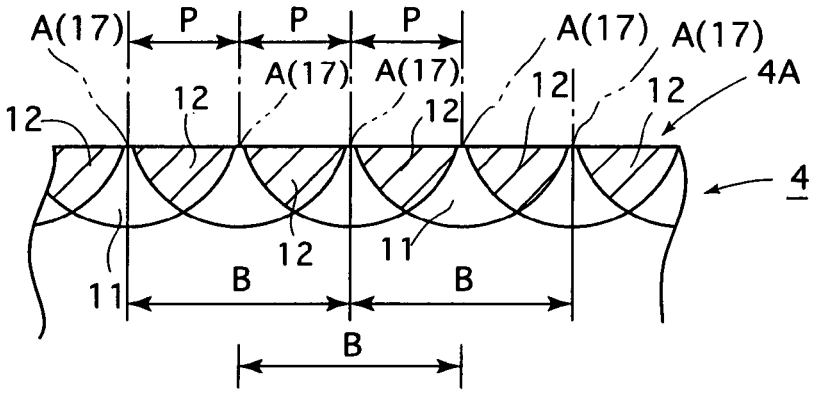
FIG. 9 is a simplified sectional view illustrating a manufacturing process of a shoe as a comparative example for the embodiment of the present invention.
Figure 10:
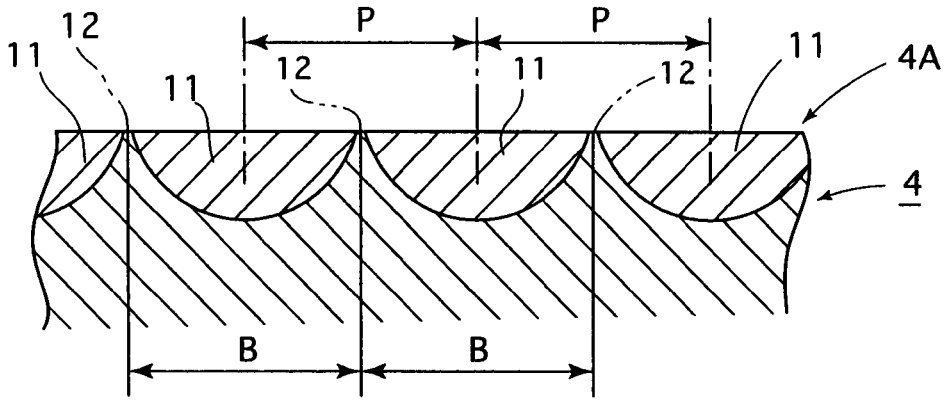
FIG. 10 is a simplified sectional view illustrating a manufacturing process of a shoe as a comparative example for the embodiment of the present invention.
Figure 11:
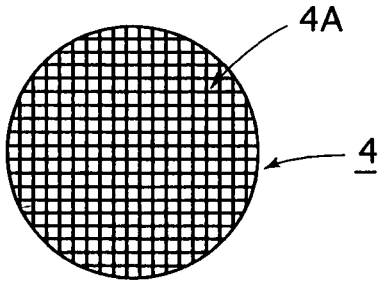
FIG. 11 is a front view of a shoe in a manufacturing process of another embodiment of the present invention.
Figure 12:
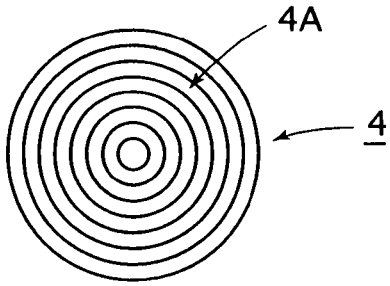
FIG. 12 is a front view of a shoe in a manufacturing process of another embodiment of the present invention.
Figure 13:
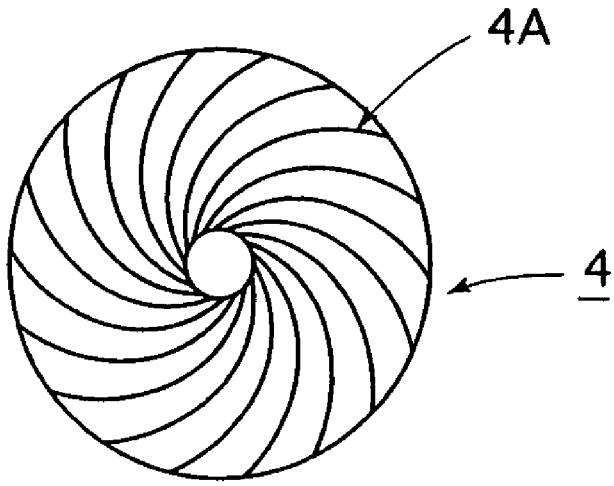
FIG. 13 is a front view of a shoe in a manufacturing process of another embodiment of the present invention.
Figure 14:
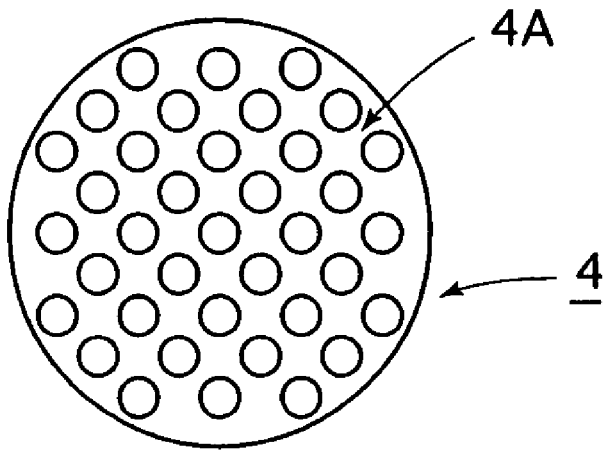
FIG. 14 is a front view of a shoe in a manufacturing process of another embodiment of the present invention.

4 . . . shoe (slide member)
4A . . . sliding surface
6' . . . swollen portion (relief)
7' . . . concave portion (relief)
A . . . parallel line
B . . . hardening width
P . . . pitch

The invention claimed is:

1. A method for manufacturing a slide member, comprising the steps of:

irradiating a laser or electronic beam on a sliding surface of a slide member to form portions on the sliding surface having different hardnesses;

smoothing the irradiated sliding surface of the slide member by removing any swollen portions of the sliding surface and forming a flat and smooth sliding surface; and buffing the smoothed sliding surface to form minute irregularities therein.

2. The method of claim 1, wherein at least one of a lattice pattern, a spiral pattern and a pattern made up of small circles are formed on the sliding surface by the irradiation of the laser or electronic beam.

3. The method of claim 1, wherein the irradiated sliding surface is smoothed by lapping.

4. The method of claim 1, wherein the slide member is a hemispheric shoe and relief is formed on the smoothed sliding surface having a height of from approximately 0.1 to 1 μm.

5. The method of claim 1, wherein the laser or electronic beam radiation forms a pattern on the sliding surface of a large number of parallel lines or concentric circles passed apart at a predetermined pitch P, the sliding surface undergoes a hardening process with a predetermined hardening width B during the irradiation thereof to concurrently give rise to the portions having different hardnesses and a ratio P/B satisfies the relationship $0.4 \leqq P/B \leqq 4.0$, P/B=1 or 0.5 being excluded.

6. The method of claim 5, wherein the parallel lines or concentric circles are a direct-hardened portion having the hardening width B and portions of the sliding surface between adjacent direct-hardened portions are double-hardened portions having a hardness less than the direct-hardened portions.

7. The method of claim 6, wherein the pitch P is from 0.1 to 1 mm and the hardening width B is 0.25 mm.

8. The method of claim 7, wherein the slide member is a hemispheric shoe, the pitch P is 0.2 mm and a relief is formed on the smoothed sliding surface having a height of from approximately 0.1 to 1 μm.

9. The method of claim 5, wherein the irradiated sliding surface is smoothed by lapping.

* * * * *